US009625135B2

(12) United States Patent
Lin et al.

(10) Patent No.: US 9,625,135 B2
(45) Date of Patent: Apr. 18, 2017

(54) ANGLE ADJUSTING DEVICE FOR PORTABLE LED LIGHT

(71) Applicant: Shenzhen Dokocom Energy Technology Co., Ltd, Shenzhen, Guangdong (CN)

(72) Inventors: Peilin Lin, Guangdong (CN); Yaoyi He, Guangdong (CN); Zhonglin Yang, Guangdong (CN)

(73) Assignee: Shenzhen Dokocom Energy Technology Co., Ltd, Shenzhen (CN)

( * ) Notice: Subject to any disclaimer, the term of this patent is extended or adjusted under 35 U.S.C. 154(b) by 21 days.

(21) Appl. No.: 14/779,567

(22) PCT Filed: Jan. 16, 2015

(86) PCT No.: PCT/CN2015/070821

§ 371 (c)(1),
(2) Date: Sep. 24, 2015

(87) PCT Pub. No.: WO2016/106860

PCT Pub. Date: Jul. 7, 2016

(65) Prior Publication Data

US 2016/0327254 A1 Nov. 10, 2016

(30) Foreign Application Priority Data

Dec. 31, 2014 (CN) ..... 2014 1 0849080

(51) Int. Cl.
*F21V 14/00* (2006.01)
*F21V 21/30* (2006.01)
(Continued)

(52) U.S. Cl.
CPC ..... *F21V 21/30* (2013.01); *F21L 2/00* (2013.01); *F21L 4/04* (2013.01); *F21V 31/005* (2013.01); *F21V 17/02* (2013.01); *F21Y 2115/10* (2016.08)

(58) Field of Classification Search
CPC ..... F21L 14/02; F21L 4/00; F21V 21/30
(Continued)

(56) References Cited

U.S. PATENT DOCUMENTS 9,316,384 B2 * 4/2016 Mumma ..... F21L 14/00
2012/0140473 A1 * 6/2012 Chang ..... F21S 2/005 362/249.03

(Continued)

FOREIGN PATENT DOCUMENTS

EP 2843303 A1 * 3/2015 ..... F21V 21/14

*Primary Examiner* — Julie Bannan

(57) ABSTRACT

Disclosed is an angle adjusting device for portable LED light, which includes two symmetrical outer housings of LED light, rotatable shafts fixed to the outer housings, two symmetrical handles, outer gears fixed on an end of the rotatable shafts, and bases. The handle is rotatably connected with the outer housing via the rotatable shafts; two pairs of guide rods are fixed on the handle; the base has an upper guide hole and a lower guide hole formed thereon; the guide rod is sleeved with a compression spring located into the upper guide hole, the base being capable of sliding up and down along the guide rod; and the base has a cavity formed at center thereof for accommodating the outer gear, a gear tooth being provided in the cavity for fitting the outer gear. It has simple structure and the angle between the two outer housings could be adjusted freely.

4 Claims, 6 Drawing Sheets

(51) Int. Cl.

| | |
|---|---|
| ***F21L 2/00*** | (2006.01) |
| ***F21V 31/00*** | (2006.01) |
| ***F21L 4/04*** | (2006.01) |
| *F21Y 115/10* | (2016.01) |
| *F21V 17/02* | (2006.01) |

(58) Field of Classification Search
USPC ..... 362/181, 196
See application file for complete search history.

(56) References Cited

U.S. PATENT DOCUMENTS

| | | | | |
|---|---|---|---|---|
| 2013/0100653 | A1* | 4/2013 | Renk, Jr. | F21L 4/022 362/184 |
| 2013/0271993 | A1* | 10/2013 | Jan | F21V 21/30 362/249.09 |
| 2014/0355278 | A1* | 12/2014 | Huang | F21S 8/036 362/427 |
| 2016/0209015 | A1* | 7/2016 | Mumma | F21V 21/30 |
| 2016/0298831 | A1* | 10/2016 | Fang | F21V 21/06 |

* cited by examiner

ANGLE ADJUSTING DEVICE FOR PORTABLE LED LIGHT

FIELD OF THE INVENTION

The present invention relates to LED light, and more particularly to an angle adjusting device for portable LED light.

BACKGROUND OF THE INVENTION

LED lights have been widely used to the life due to the advantages of long service life, high efficiency, energy saving and safe. And the portable LED lights are generally used for outdoor lighting or charging external devices and so on due to the advantages of small size and easy to carry. However, the existing portable LED lights have some disadvantages as follows: after being fixed to a holder, the portable LED light is hard to be adjusted freely, and even its angle can be adjusted, it is hard to be fixed at a certain angle after being adjusted.

SUMMARY OF THE INVENTION

One object of the present invention is to provide an angle adjusting device for portable LED light so as to overcome the defects of the prior art.

To achieve above objects, there is provided a technical solution as follows:

An angle adjusting device for portable LED light includes two symmetrical outer housings of LED light, rotatable shafts fixed to the outer housings, two symmetrical handles and outer gears fixed on an end of the rotatable shafts. The handle is rotatably connected with the outer housing via the rotatable shafts; two pairs of guide rods are fixed on a bottom of an inner wall of the handle, each pair of the guide rods comprising two guide rods and each guide rod having a circular stopper formed thereon and close to an outer end of the guide rod; and further comprises a base provided on an inner side of the handle, each of two sides of the base having an upper guide hole and a lower guide hole formed thereon, both of which are capable of sliding up and down along the guide rod, and bore diameter of the upper guide hole being larger than that of the lower guide hole and smaller than a diameter of the circular stopper; the guide rod is sleeved with a compression spring which is located into the upper guide hole, the base being capable of sliding up and down along the guide rod under an action of external force; and the base has a cavity formed at center thereof for accommodating the outer gear, a gear tooth being provided on a top of an inner wall of the cavity for fitting the outer gear, and a sum of whole depth of the gear tooth and outside radius of the outer gear being smaller than a radius of the cavity.

In a preferred embodiment, a first waterproof ring is provided between the rotatable shaft and the outer housing.

In a preferred embodiment, a second waterproof ring is provided between the rotatable shaft and the handle.

In a preferred embodiment, one of the outer housings has a locking element provided on a side thereof and opposite to the handle; and the other one of the outer housings has a groove formed thereon for fitting the locking element.

Compared with the prior art, the present invention has following beneficial effects: under the action of the compression spring, the base will be pressed towards the bottom of the handle by the compression spring, the outer gear will engage with the gear tooth provided in the cavity, if the outer housing rotates under the action of external force, the rotatable shaft and the outer gear will rotate driven by the outer housing, the outer gear will act on the gear tooth provided in the cavity, the gear tooth will in turn drive the base move up and then the gear tooth in the cavity will engage with the next tooth of the outer gear, at the same time, the base will be pressed towards the bottom of the handle by the compression spring, thereby the outer housings and handles will be fixed at a certain angle. By this, the angle between the two outer housings could be adjusted and also could be fixed after be adjusted.

Other aspects, features, and advantages of the present invention will become apparent from the following detailed description when taken in conjunction with the preferred embodiment and the accompanying drawings, which are a part of this disclosure and which illustrate, by way of example, principles of the present invention.

DETAILED DESCRIPTION OF ILLUSTRATED EMBODIMENTS

Some embodiments of the present invention will be described as follows, by way of example only, with reference to the accompanying drawings. And it should be noted that the features of different embodiments could be combined if there is no conflicts.

Figure 1:
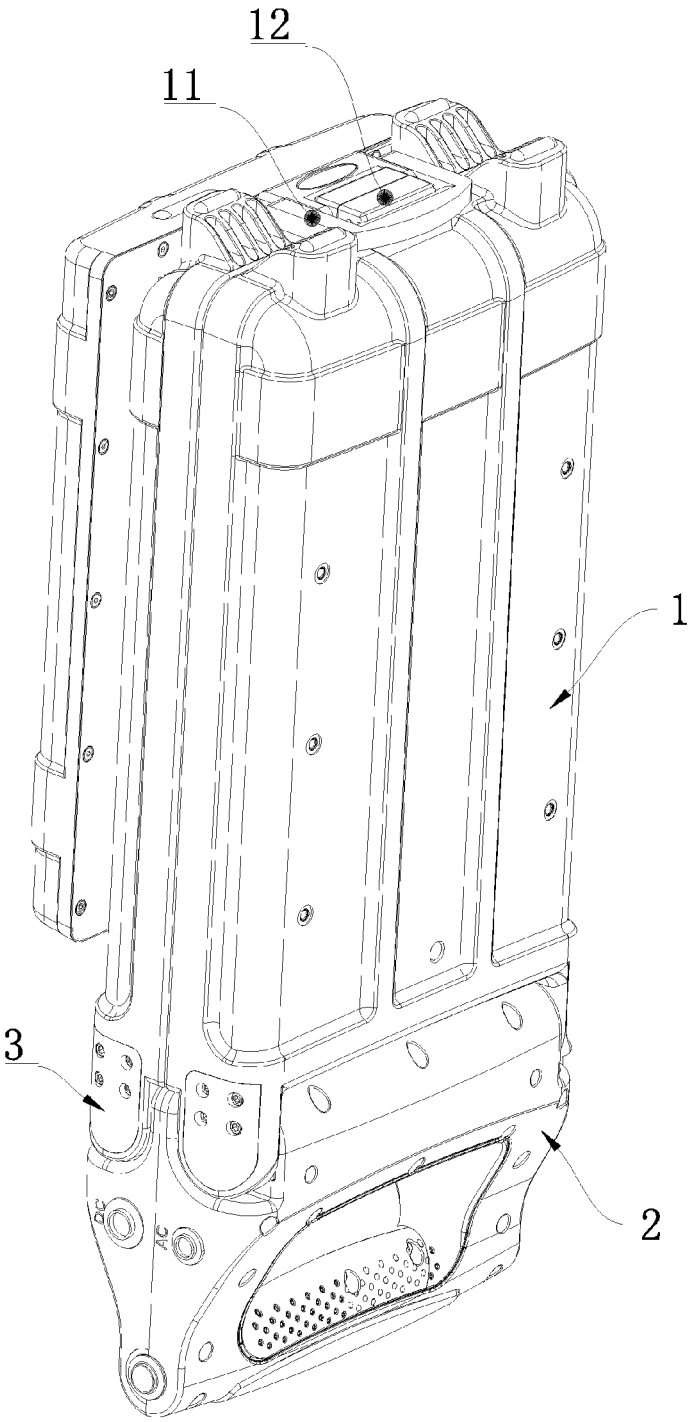
FIG. 1 illustrates an external construction of the present invention.
Figure 2:
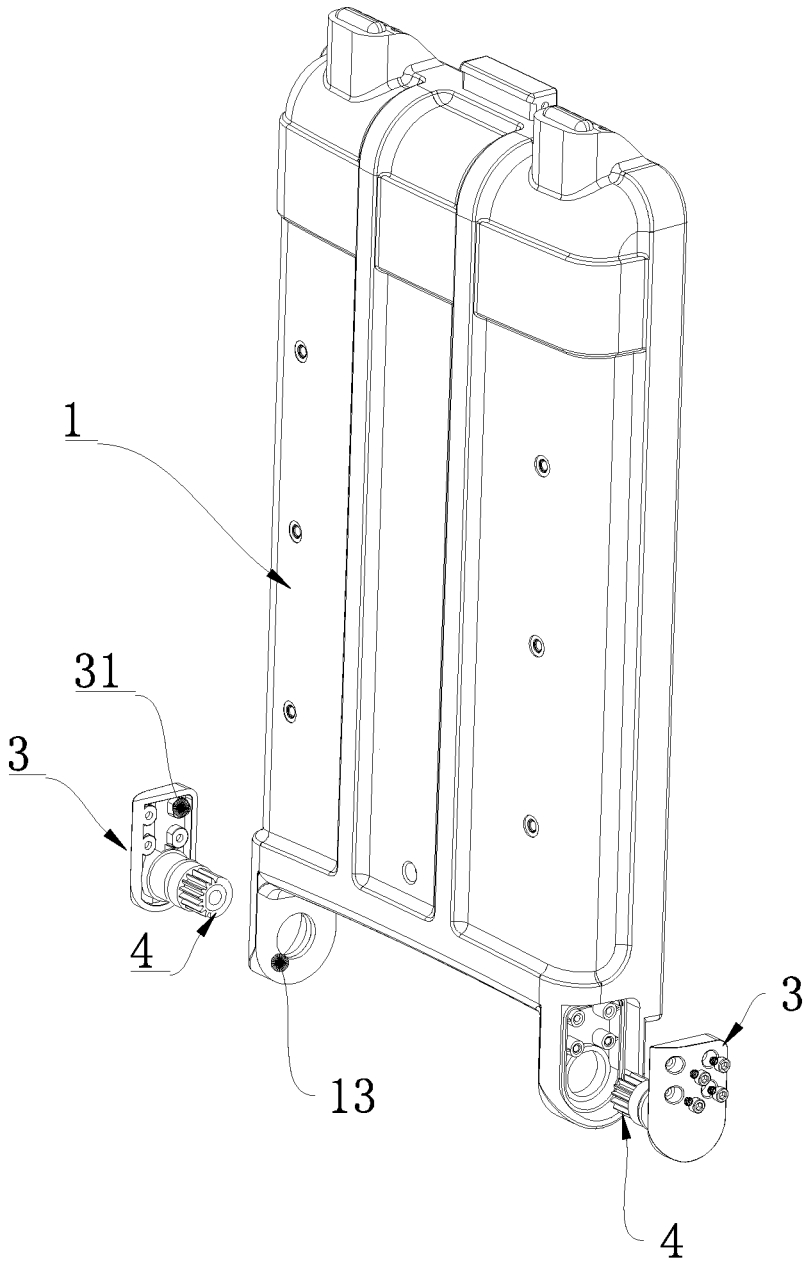
FIG. 2 illustrates rotatable shafts and an outer housing of LED light of the present invention.
Figure 3:
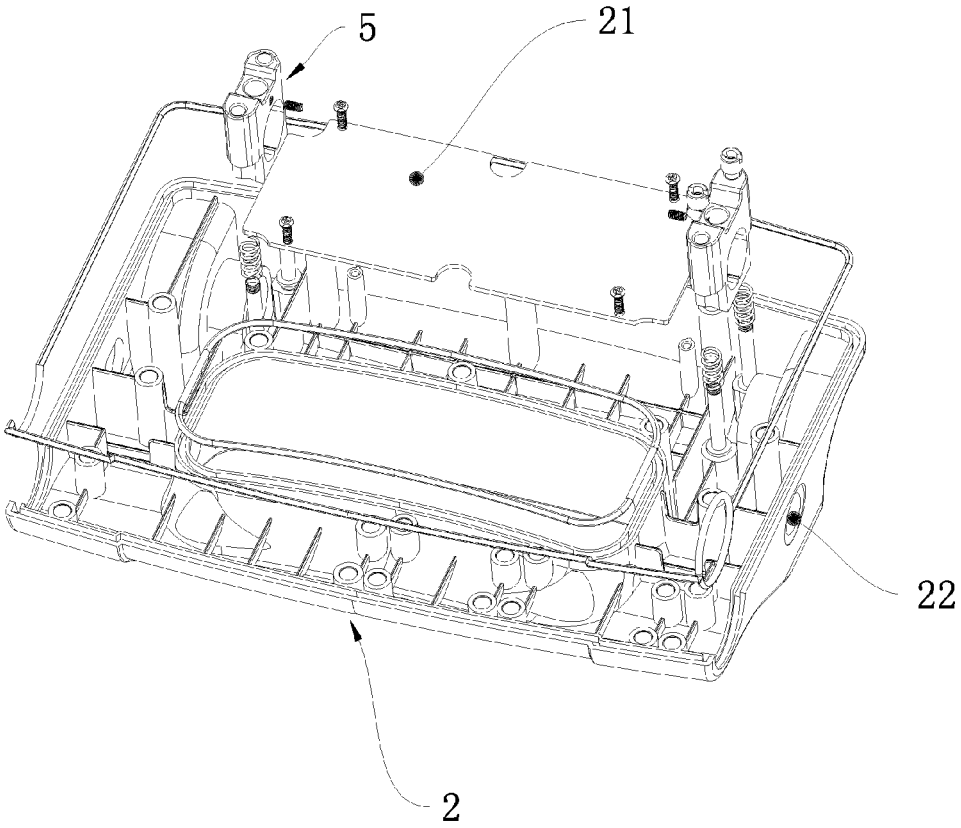
FIG. 3 illustrates a handle of the present invention.
Figure 4:
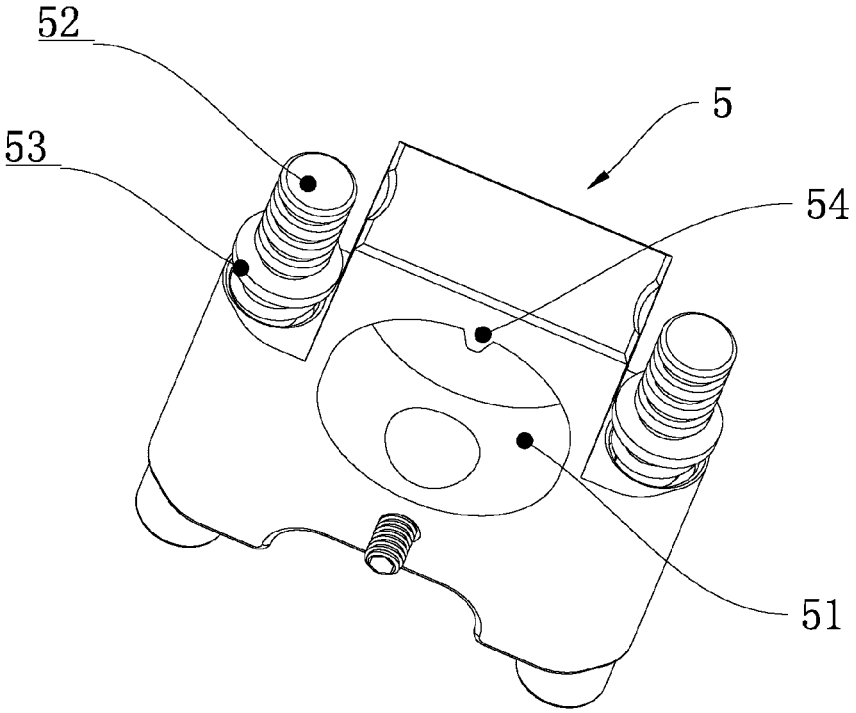
FIG. 4 illustrates a base of the present invention.
Figure 5:
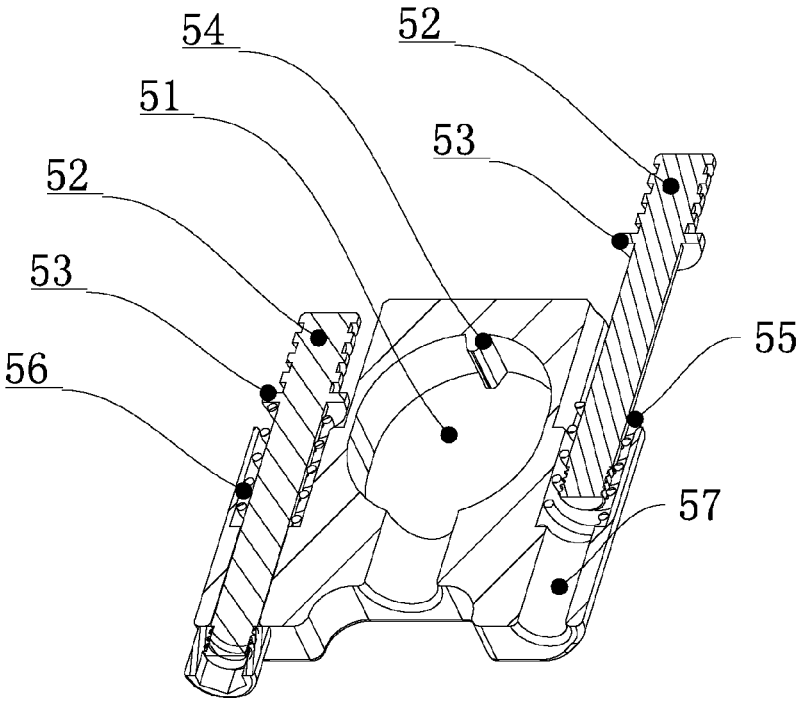
FIG. 5 is a section view of the base of the present invention.
Figure 6:
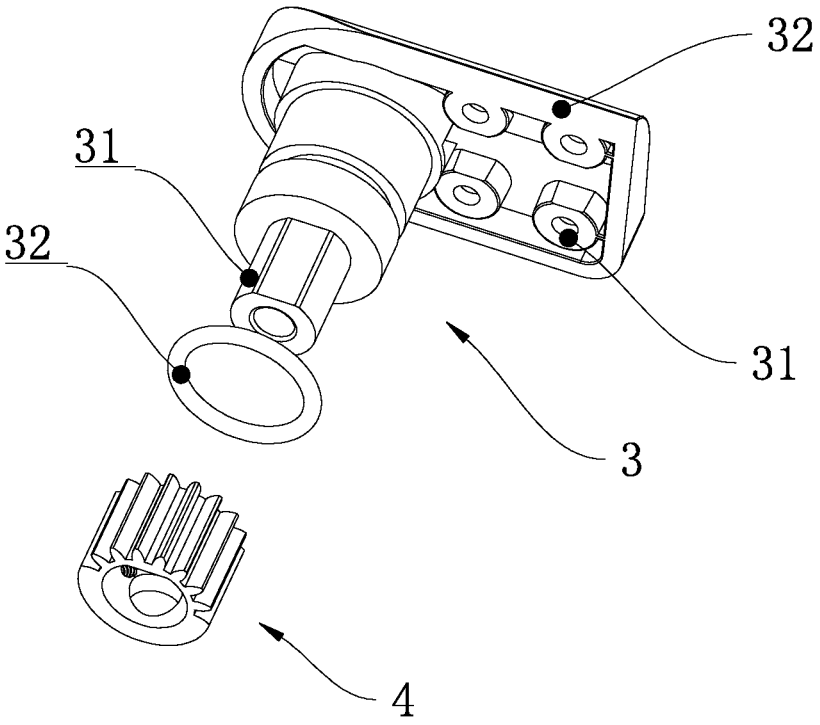
FIG. 6 illustrates a rotatable shaft and an outer gear of the present invention.
Figure 7:
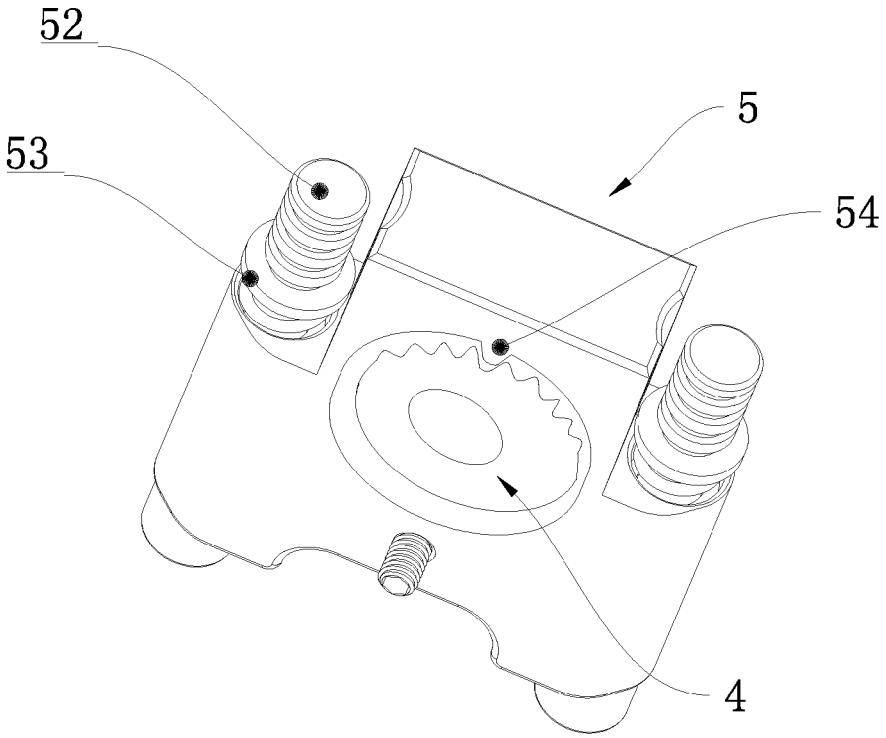
FIG. 7 illustrates a base engaging with an outer gear of the present invention.

As shown from FIG. 1 to FIG. 7, an angle adjusting device for portable LED light includes symmetrical outer housings 1 of LED light, rotatable shafts 3 fixed to the outer housings 1, bases 5, symmetrical handles 2 and outer gears 4 fixed on an end of the rotatable shafts 3. A connecting piece 32 extending from the rotatable shaft 3 along a radial direction has threaded holes 31 formed thereon. The outer housing 1 has first rotating holes 13 formed thereon and the handle 2 has second rotating holes 22 formed thereon. The rotatable shaft 3 is inserted into the first rotating hole 13 and the second rotating hole 22, the connecting piece 32 is fixed to the outer housing 1 with screws, and the handle 2 is rotatably connected with the outer housing 1 via the rotatable shafts. Each of the outer gears 4 is fixed to each rotatable shaft 3, and specifically, the outer gear 4 has an axle hole formed thereon and by means of which the outer gear 4 is mounted on the rotatable shaft 3. The outer gear 4 has several threaded holes formed thereon in a radial direction of the axle hole, the rotatable shaft 3 also has several threaded holes formed thereon, and then the outer gear 4 could be fixed to the rotatable shaft 3 with screws. In another embodiment, the outer gear 4 has a keyway formed thereon in an axial direction of the axle hole, the rotatable shaft 3 also has a keyway formed thereon, and then the outer gear 4 could be fixed to the rotatable shaft 3 with a key. Two pairs of guide rods 52 are fixed on a bottom of an inner wall of the handle 2, each pair of the guide rods including two guide rods 52 and each guide rod 52 having a circular stopper 53 formed thereon and close to an outer end of the guide rod 52. Each of two sides of the base 5 has an upper guide hole 56 and a lower guide hole 57 formed thereon, both of which are capable of sliding up and down along the guide rod 52. The bore diameter of the upper guide hole 56 is larger than that of the lower guide hole 57 and smaller than a diameter of the circular stopper 52. The guide rod 52 is sleeved with a compression spring 55 which is located into the upper guide hole 56 and presses the base 5 towards the bottom of the inner wall of the handle 2, the base 5 being capable of sliding up and down along the guide rod 52 under the action of external force. The base 5 further has a cavity 51 formed at center thereof for accommodating the outer gear 4, and a gear tooth 54 is provided on a top of an inner wall of the cavity 51 for fitting the outer gear 4. The sum of whole depth of the gear tooth 54 and outside radius of the outer gear 4 is smaller than a radius of the cavity 51. The gear tooth 54 is capable of moving freely in the cavity 51 under the action of external force.

When a certain angle is formed between the two symmetrical outer housings 1, one of the teeth of the outer gear 4 engages with the gear tooth 54 so as to produce engaging force, at the same time, the base 5 is pressed towards the bottom of the handle 2 by the compression spring 55 so as to availably prevent the gear tooth 54 from rotating relative to the outer gear 4, thereby allowing the two symmetrical outer housings 1 to be fixed at a certain angle. When need to adjust the angle between the two outer housings 1, because the outer gear 4 is fixed to the connecting piece 32 of the rotatable shaft 3, the rotatable shaft 3 will rotate by rotating the outer housing 1, the outer gear 4 will in turn rotate driven by the rotatable shaft 3, and then the outer gear 4 will push the base 5 to move in a direction away from the bottom of the handle 2. When the base 5 moves up through a distance, the tooth of the outer gear 4 which is engaging with the gear tooth 54 will pass over the gear tooth 54 and then the next tooth of the outer gear 4 will engage with the gear tooth 54, at the same time the base 5 will be pressed towards the bottom of the handle 2 by the compression spring 55 so as to availably prevent the gear tooth 54 from rotating relative to the outer gear 4, thereby allowing the two symmetrical outer housings 1 to be fixed at another angle.

In this embodiment, in order to reduce processing cost, only half of the periphery of the outer gear 4 is provided with teeth. A first waterproof ring 32 is provided between the rotatable shaft 3 and the outer housing 1 and a second waterproof ring is provided between the rotatable shaft 3 and the handle 2. Both of which are provided to prevent the water vapor from entering the inside of the portable LED light. One of the outer housings 1 has a locking element 11 provided on a side thereof and opposite to the handle and the other one of the outer housings 1 has a groove 12 formed thereon for fitting the locking element 11. After being folded, the two outer housings 1 could be locked together by means of the cooperation of the locking element 11 and the groove 12.

Above descriptions of embodiments are provided for further illustrating the technical content of the present invention, so as to facilitate understanding and it should be understood that the invention is not to be limited to the disclosed embodiments. Any technique extension and recreation according to the present invention should be included within the scope of protection of the invention.

What is claimed is:

1. An angle adjusting device for a portable LED light, wherein the portable LED comprises two symmetrical outer housings, each symmetrical housing comprising a rotatable shaft fixed to the outer housing, outer gears fixed on an end of the rotatable shaft, and opposing symmetrical handles; wherein each handle is rotatably connected with the outer housing via the rotatable shaft; two pairs of guide rods are fixed on a bottom of an inner wall of each handle, each pair of the guide rods comprising two guide rods and each guide rod having a circular stopper formed thereon and close to an outer end of the guide rod; and a base provided on an inner side of each handle, each of two sides of the base having an upper guide hole and a lower guide hole formed thereon which are capable of sliding up and down along the two guide rods, and bore diameter of the upper guide hole being larger than that of the lower guide hole and smaller than a diameter of the circular stopper; and wherein the guide rod is sleeved with a compression spring which is located in the upper guide hole, the base being capable of sliding up and down along the guide rod under an action of external force; and the base having a cavity formed at center thereof for accommodating the outer gear, a gear tooth being provided on a top of an inner wall of the cavity for fitting the outer gear, and a sum of whole depth of the gear tooth and outside radius of the outer gear being smaller than a radius of the cavity.

2. The angle adjusting device according to claim 1, wherein a first waterproof ring is provided between the rotatable shaft and the outer housing.

3. The angle adjusting device according to claim 1, wherein a second waterproof ring is provided between the rotatable shaft and the handle.

4. The angle adjusting device according to claim 1, wherein one of the outer housings has a locking element provided on a side thereof and opposite to the handle; and the other one of the outer housings has a groove formed thereon for fitting the locking element.

* * * * *